US007299588B2

(12) United States Patent
Diaz et al.

(10) Patent No.: US 7,299,588 B2
(45) Date of Patent: Nov. 27, 2007

(54) ROOF TARP

(76) Inventors: Antonio Diaz, 8391 NW. 142 St., Hialeah, FL (US) 33016-5728; Ernesto Alonso, 450 W. 44 Pl., Hialeah, FL (US) 33012

( * ) Notice: Subject to any disclaimer, the term of this patent is extended or adjusted under 35 U.S.C. 154(b) by 91 days.

(21) Appl. No.: 11/339,877

(22) Filed: Jan. 26, 2006

(65) Prior Publication Data

US 2007/0193121 A1 Aug. 23, 2007

(51) Int. Cl.
*E04B 1/34* (2006.01)

(52) U.S. Cl. ..... 52/3

(58) Field of Classification Search ..... 52/3, 52/4, 5, 746.1, 746.11, DIG. 13, 14, DIG. 16, 52/202, 23, DIG. 12; 150/154, 166
See application file for complete search history.

(56) References Cited

U.S. PATENT DOCUMENTS 1,871,101 A * 8/1932 Waltz ..... 135/119
2,977,267 A * 3/1961 Douthitt ..... 206/447
3,185,197 A * 5/1965 Spiro et al. ..... 150/154
3,202,193 A * 8/1965 Ware ..... 383/37
4,862,638 A * 9/1989 Stevenson ..... 43/114
5,813,172 A * 9/1998 McNally ..... 52/2.25

* cited by examiner

*Primary Examiner*—Carl D. Friedman
*Assistant Examiner*—William Gilbert
(74) *Attorney, Agent, or Firm*—Ruben Alcoba, Esq.

(57) ABSTRACT

The present invention is a roof tarp. The roof tarp is a square or rectangular shaped tarp that has a first and a second face. The tarp has a tar strip that runs parallel and abuts all edges of the tarp, the tar strip is at-least two and a half inches in width from each edge of the tarp and is at-least a half inch in height from the first face of the tarp. A cellophane covering overlaps the tar strip. A ridge is defined on the first face of the tarp. The ridge is adjacent to the tar strip and runs parallel to the tar strip. The ridge is at least half an inch in height. A first hook and loop material attachment means that is attached to the first face of the tarp and that runs parallel and is adjacent to the ridge of the tarp, the hook and loop attachment means is at least a half an inch inwards from the ridge. A second hook and loop attachment means attached to the second face of the tarp, the second hook and loop attachment means is located the same distance from the edges of the tarp as the first hook and loop attachment means. On each corner of the tarp, there is grommet attached. A lifting means is attached to the grommet.

5 Claims, 5 Drawing Sheets

ROOF TARP

BACKGROUND

During the Hurricane season of 2005, the inventors realized that there was a need to provide homeowners with a better way of dealing with wind damaged roofs. During the season, homeowners who had damaged roofs contacted contract roofers to place blue tarps on their roofs. As was carefully noted on television, roofers were overcharging the government and homeowners when placing blue tarps on wind damaged roofs. It was also noted that only flat/shingle roofs could be protected by blue tarps. In other words, if you had a barrel tile roof, you were out of luck.

The inventors realized that there had to be a way of providing home owners with a cost effective tarp that would easily be applied to ones roof, regardless of the roof type. They further realized that materials were hard to find after natural emergencies. The inventors therefore invented a tarp that could easily be applied to ones roof with out the need of contracting a roofer.

The customary way of applying blue tarps to wind damaged roofs is known in the art. The materials needed are nails, sand bags, blue tarps, and wood strips. The method of patching a damaged roof is by first placing a blue tarp over the wind damaged part of the roof. Then, the blue tarp is secured to the roof. Lastly, wood strips are placed to run perpendicular to the horizontal axis of the roof and then nailed to the roof. As can be seen by the method, under normal circumstances, the method of patching a roof is beyond the scope of a normal homeowner.

An object of this invention is to it eliminate the need of using contractors to place an emergency tarp on a wind damaged roof.

Another object of this invention is to minimize the costs incurred when temporarily patching a roof.

Yet another object of this invention is to minimize the elements needed to temporarily patch a roof.

A further object of this invention is to provide a tarp that can easily be lifted upon a damaged roof.

Another object of this invention is to minimize the damage incurred when placing a tarp on a damaged roof.

Yet another object of this invention is to provide a tarp that can be applied to a barrel tile roof.

SUMMARY

The present invention is a roof tarp. The tarp eliminates the need of using nails, sandbags, and wood strips to a wind damaged roof. This makes the tarp user friendly to most homeowners, for they do not have to lift un-needed elements onto a roof. The roof tarp further allows homeowners to patch barrel type roofs.

The roof tarp is a square or rectangular shaped tarp that has a first and a second face. The tarp has a tar strip that runs parallel and abuts all edges of the tarp, the tar strip is at-least two and a half inches in width from each edge of the tarp and is at-least a half inch in height from the first face of the tarp. A cellophane covering covers the tar strip. A ridge is defined on the first face of the tarp. The ridge is adjacent to the tar strip and runs parallel to the tar strip. The ridge is at least half an inch in height. A first hook and loop material attachment means is attached to the first face of the tarp and runs parallel and is adjacent to the ridge of the tarp, the hook and loop attachment means is at least a half an inch inwards from the ridge. A second hook and loop attachment means is attached to the second face of the tarp, the second hook and loop attachment means is located the same distance from the edges of the tarp as the first hook and loop attachment means. A grommet is attached to each corner of the tarp. A lifting means is attached to the grommets.

The roof tarp is used by placing the tarp's first face over the damaged roof, then removing the cellophane covering from the tar strip, then applying pressure to the second face of the tarp at locations immediately above the tar strip so that the tar adheres to the roof.

DRAWINGS

These and other features, aspects, and advantages of the present invention will become better understood with regard to the following description, appended claims, and drawings where:

FIG. 1*a* shows a roof tarp on a barrel type damaged roof;

FIG. 1*b* shows the roof tarp on a shingle type damaged roof;

Figure 4B:
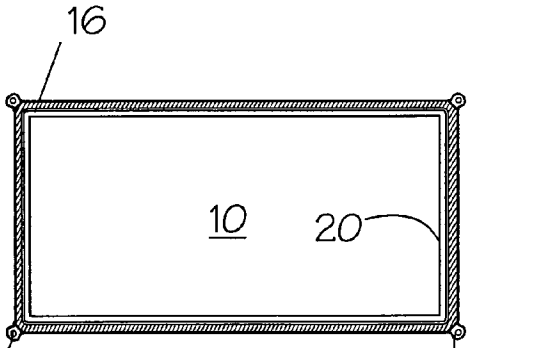
Figure 4A:
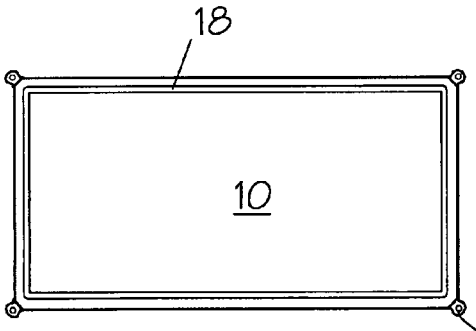
Figure 5:
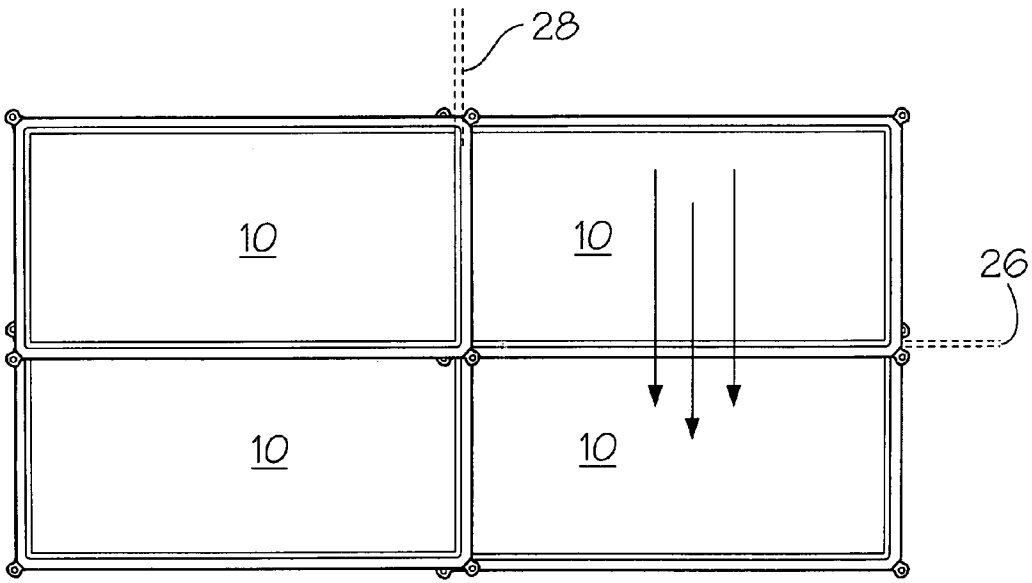
Figure 6A:
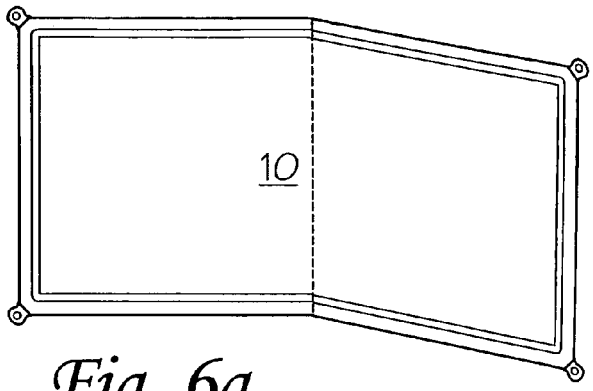
Figure 6B:
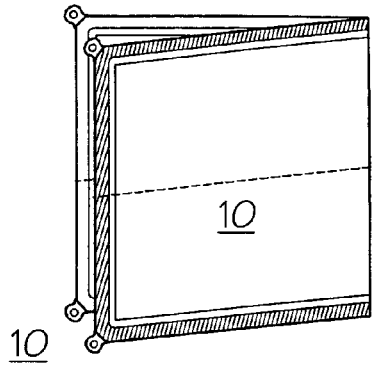
Figure 6C:
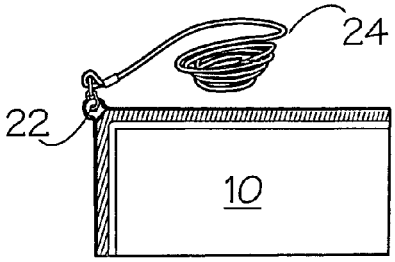

FIGS. 4*a*-4*b* shows both faces of the roof tarp;

FIG. 5 shows a plurality of tarps being attached and aligned together;

FIGS. 6*a*-6*b* shows a method of folding the roof tarp so that all grommets are aligned together;

FIG. 6*c* shows a rope being attached to the grommets of the roof tarp; and

Figure 6D:
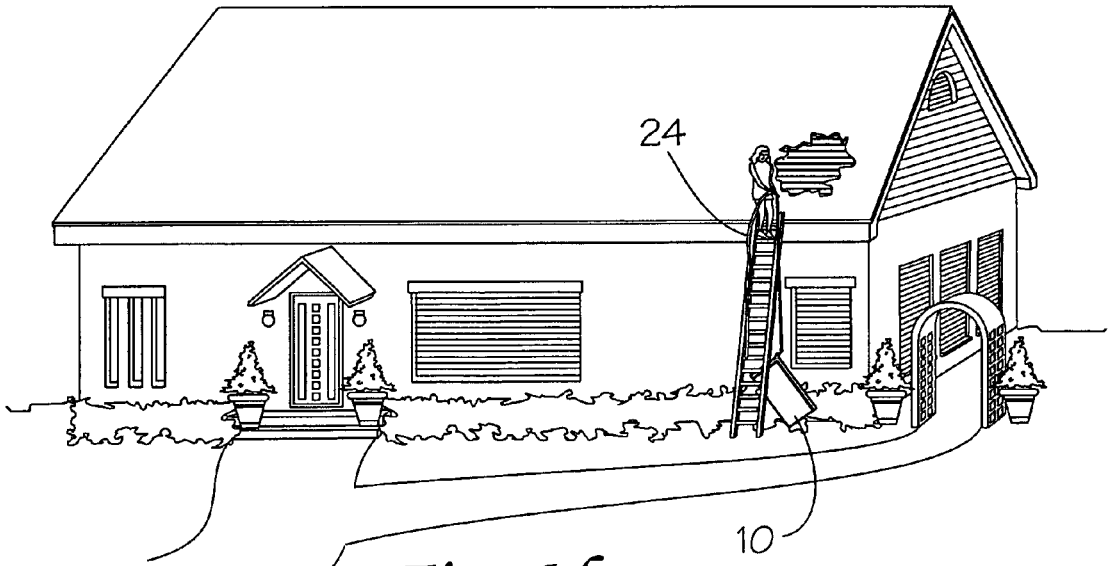

FIG. 6*d* shows a homeowner lifting a roof tarp onto a roof.

DESCRIPTION

Figure 3:
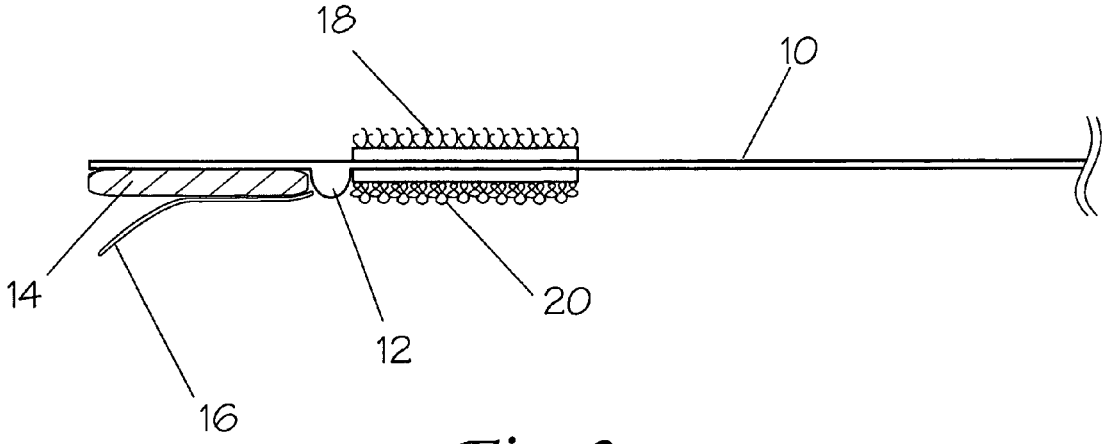
FIG. 3 is a side view of the roof tarp wherein the placement of the tar strip, the cellophane covering, the ridge, and the hook and loop attachment means are shown.

As shown in FIGS. 3-4*b*, a roof tarp comprises a square or rectangular shaped tarp 10 having a first and a second face, a tar strip 14 that runs parallel and abuts all edges of the tarp 10, the tar strip 14 is at-least two and a half inches in width from each edge of the tarp 10 and is at-least a half inch in height from the first face of the tarp 10, a cellophane covering 16 attached and covering the tar strip 14, a ridge 12 defined on the first face of the tarp 10, wherein the ridge 12 is adjacent to the tar strip 14 and runs parallel to the tar strip 14, the ridge is at least half an inch in height 12. The tarp can be made of any material known in the art which is used to cover damaged roofs, for example, poly tarpaulin.

In a further embodiment of the invention described above, the tarp 10 further comprises of a first hook and loop material attachment means 20 attached to the first face of the tarp 10 and running parallel and adjacent to the ridge 12 of the tarp 10, the hook and loop attachment means 20 is at least a half an inch inwards from the ridge 12, and a second hook and loop attachment means 18 attached to the second face of the tarp 10, the second hook and loop attachment means 18 is located the same distance from the edges of the tarp 10 as the first hook and loop attachment means 20.

In yet a further embodiment of the invention above, as seen in FIGS. 4*a*-6*c*, the tarp 10 further comprises of four grommets 22, wherein each grommet 22 is attached to the tarp 10 at each corner of the tarp 10, and a lifting means 24 attached to the grommets 22. The lifting means might be a rope or a cable. Each Grommet 22 is reinforced to be able to hold the weight of the tarp 10 without ripping from the tarp 10.

A method of using the tarp 10 described above which comprising the steps of first lifting the tarp 10 on to a damaged roof, then placing the first face of the tarp over the damaged roof, next removing the cellophane covering 16 from the tar strip 14, and lastly applying pressure to the second face of the tarp 10 at a location immediately above the tar strip 14 so that the tar strip 14 adheres to the roof.

As seen in FIG. 5, the inventors have further invented a method of using at-least two of the roof tarps described above in conjunction with each other to cover a larger area of a damaged roof. The method of using at-least two roof tarps described above comprises the steps of lifting the tarps 10 on to a damaged roof, aligning the first face of the tarps 10 with the second face of the tarps 10 at the hook and loop attachment means 18/20 so that the edges of the tarps 10 are linearly aligned 26/28, attaching the hook and loop attachment means 18, 20 together, placing the first faces of the tarps 10 over the damaged roof, removing the cellophane coverings 16 from the tar strips 14, and applying pressure to the second faces of the tarps 10 at locations immediately above the tar strips 14 so that the tar strips adhere to the roof.

As seen in FIGS. 6*a*-6*c*, the tarp 10 is folded together prior to lifting the tarp onto a roof. Upon the tarp being folded so that all grommets are overlapping each other, a lifting means 24 is attached to the grommets 22. FIG. 6*c* shows a homeowner lifting the tarp 10 onto a roof.

Figure 1A:
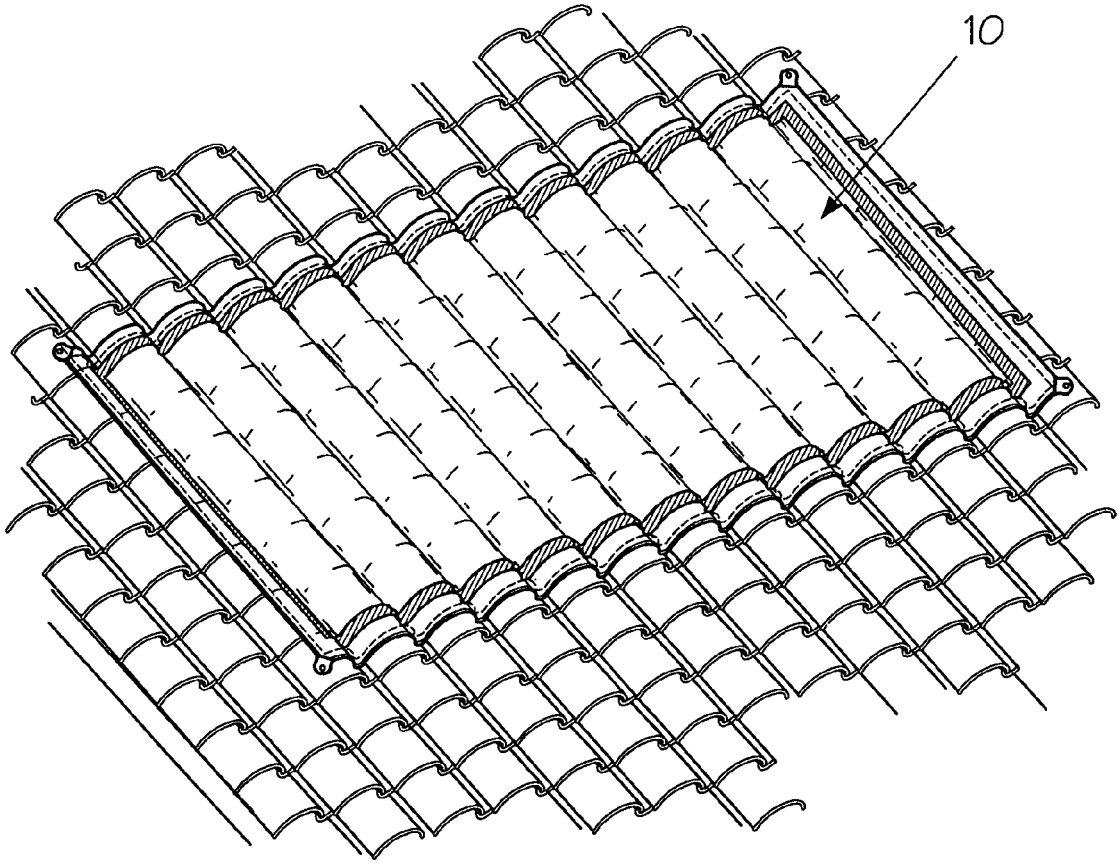
Figure 16:
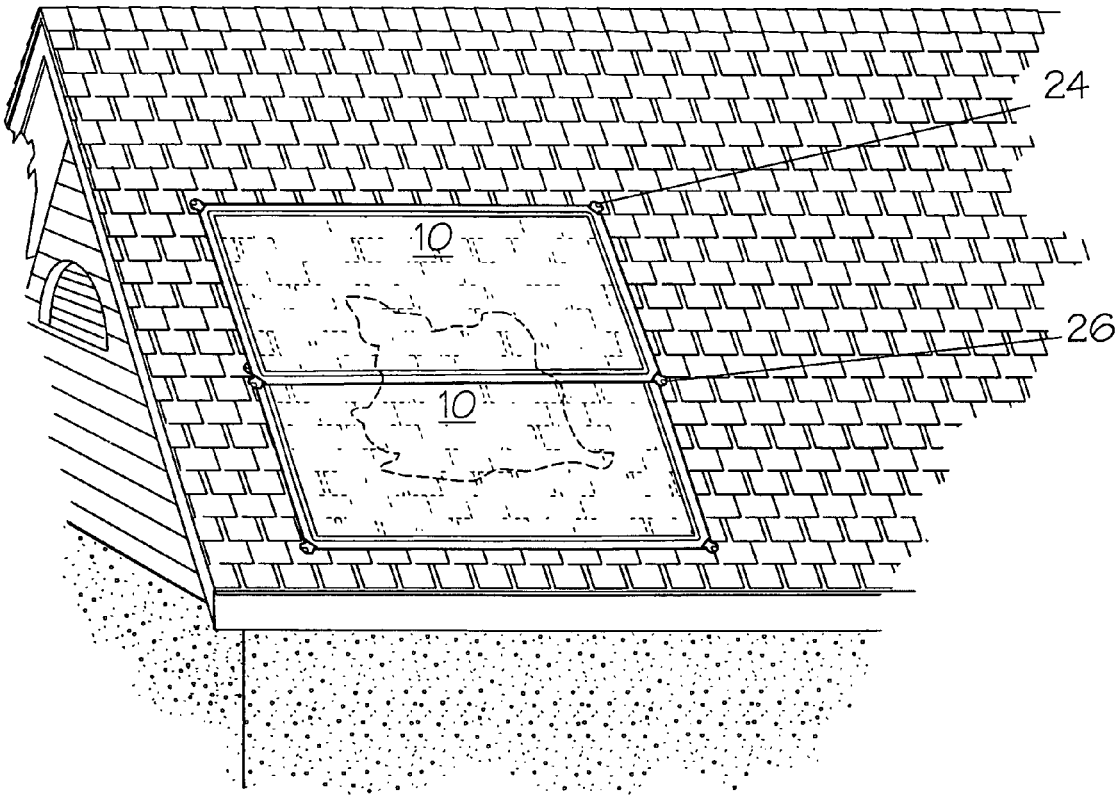
Figure 2:
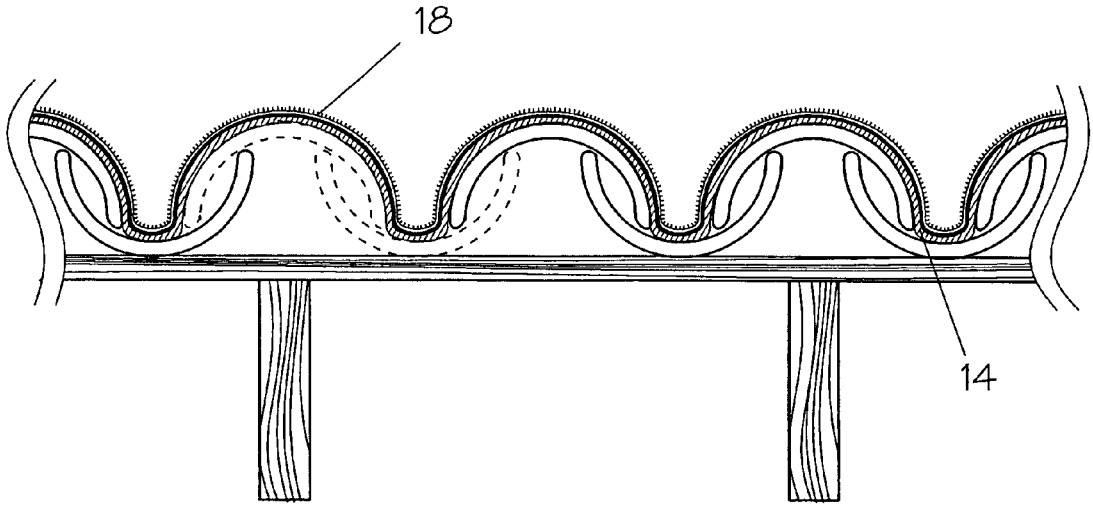
FIG. 2 is a side view of the roof tarp applied on a barrel type roof.

As seen in FIGS. 1*a*-*b*, the roof tarp can be used on either shingle roofs or barrel tile roofs.

An advantage of this invention is that it eliminates the need of using a contractor/roofer to place emergency tarp over a wind damaged roof.

Another advantage of this invention is that it is a cost effective way of temporarily patching a damaged roof.

Yet another advantage of this invention is that it minimizes the elements needed to temporarily patch a roof.

A further advantage of this invention is that it can easily be lifted onto a damaged roof.

Another advantage of this invention is that it minimizes the damage to ones roof when securing the tarp to the damaged roof.

Yet another advantage of this invention is that it can be applied to a barrel tile roof.

Although the present invention has been described in considerable detail with reference to certain preferred versions thereof, other versions are possible. Therefore the spirit and the scope of the claims should not be limited to the description of the preferred versions contained herein.

What is claimed is:

1. A roof tarp comprising:

a square or rectangular shaped tarp having a first and a second face;

a tar strip that runs parallel and abuts all edges of the tarp, the tar strip is at-least two and a half inches in width from each edge of the tarp and is at-least a half inch in height from the first face of the tarp;

a cellophane covering attached and covering the tar strip;

a ridge defined on the first face of the tarp, wherein the ridge is adjacent to the tar strip and runs parallel to the tar strip, the ridge is at least half an inch in height;

a first hook and loop material attachment means attached to the first face of the tarp and running parallel and adjacent to the ridge of the tarp, the hook and loop attachment means is at least a half an inch inwards from the ridge; and a second hook and loop attachment means attached to the second face of the tarp, the second hook and loop attachment means is located the same distance from the edges of the tarp as the first hook and loop attachment means.

2. The roof tarp of claim 1, further comprising:

a grommet, wherein the grommet is attached to the tarp at each corner of the tarp; and a lifting means attached to the grommet.

3. The roof tarp of claim 2, wherein the lifting means is a rope.

4. A method of using the roof tarp of claim 1, comprising the steps of:

lifting the roof tarp on to a damaged roof;

placing the first face of the roof tarp over the damaged roof;

removing the cellophane covering from the tar strip; and applying pressure to the second face of the tarp at a location immediately above the tar strip so that the tar adheres to the roof.

5. A method of using the roof tarp of claim 1, comprising the steps of:

lifting at-least two tarps on to a damaged roof;

aligning the first face of the tarps with the second face of the tarps at the hook and loop attachment means so that the edges of the roof tarps are linearly aligned;

attaching the hook and loop attachment means together;

placing the first faces of the roof tarps over the damaged roof;

removing the cellophane coverings from the tar strips; and applying pressure to the second faces of the tarps at locations immediately above the tar strips so that the tar adheres to the roof.

* * * * *